US011764007B2

(12) United States Patent
Hsu et al.

(10) Patent No.: US 11,764,007 B2
(45) Date of Patent: Sep. 19, 2023

(54) KEY STRUCTURE

(71) Applicant: Lite-On Technology Corporation, Taipei (TW)

(72) Inventors: Kuo-Hui Hsu, Taipei (TW); Xiaoqiang Liang, Taipei (TW); Lei Shi, Taipei (TW); Xuelei Liu, Taipei (TW)

(73) Assignee: Lite-On Technology Corporation, Taipei (TW)

( * ) Notice: Subject to any disclaimer, the term of this patent is extended or adjusted under 35 U.S.C. 154(b) by 0 days.

(21) Appl. No.: 17/524,707

(22) Filed: Nov. 11, 2021

(65) Prior Publication Data

US 2022/0189715 A1 Jun. 16, 2022

Related U.S. Application Data

(60) Provisional application No. 63/125,957, filed on Dec. 15, 2020.

(30) Foreign Application Priority Data

Jul. 12, 2021 (CN) ..... 202121575608.9

(51) Int. Cl.
*H01H 13/705* (2006.01)
*H01H 13/86* (2006.01)
*H01H 13/14* (2006.01)

(52) U.S. Cl.
CPC ..... *H01H 13/705* (2013.01); *H01H 13/14* (2013.01); *H01H 13/86* (2013.01)

(58) Field of Classification Search
CPC ..... H01H 3/00; H01H 3/12; H01H 3/125; H01H 3/70; H01H 13/14; H01H 13/86; H01H 13/705; H01H 2003/12; H01H 13/52; H01H 13/70; H01H 2003/02; H01H 2013/00; H01H 2013/02; H01H 2013/50; H01H 2013/52; H01H 2217/00; H01H 2217/002; H01H 2221/00; H01H 3/122
USPC ..... 200/5 A
See application file for complete search history.

(56) References Cited

U.S. PATENT DOCUMENTS 11,177,084 B1 * 11/2021 Liu ..... H01H 3/125
2010/0252407 A1 * 10/2010 Merminod ..... H01H 11/00 200/312
2019/0304716 A1 * 10/2019 Zhang ..... H01H 3/125
2020/0328044 A1 * 10/2020 Chao ..... H01H 13/705

* cited by examiner

*Primary Examiner* — Anthony R Jimenez
(74) *Attorney, Agent, or Firm* — JCIPRNET

(57) ABSTRACT

A key structure, which includes a bottom plate, a keycap, an elastic element, a first bracket, and a second bracket. The keycap is disposed on the bottom plate and has multiple first pivoting portions. The elastic element is disposed under the keycap. The first bracket is disposed between the keycap and the bottom plate, and the first bracket is pivotally connected to the first pivoting portions. The second bracket is disposed between the keycap and the bottom plate, the second bracket is rotatably pivoted to the first bracket, and the number of the first pivoting portions is greater than two.

11 Claims, 13 Drawing Sheets

KEY STRUCTURE

CROSS-REFERENCE TO RELATED APPLICATION

This application claims the priority benefit of U.S. provisional application Ser. No. 63/125,957, filed on Dec. 15, 2020 and China application serial no. 202121575608.9, filed on Jul. 12, 2021. The entirety of the above-mentioned patent applications is hereby incorporated by reference herein and made a part of this specification.

BACKGROUND

Technology Field

The invention relates to a key structure, and particularly, to a key structure that reduces noise when in use.

Description of Related Art

Keyboards are commonly used as an input device of an electronic device. To allow users to use a keyboard flexibly, a balance bar is usually disposed in a longer key structure to improve the structural strength and stability of keycaps. However, when the keycap moves up and down, usually the collision between the balance bar and the bottom plate generates noise. The noise problem caused by pressing the key structure needs to be further improved.

SUMMARY

The invention provides a key structure with reduced noise when the key structure is pressed.

The key structure of the invention includes a bottom plate, a keycap, an elastic element, a first bracket, and a second bracket. The keycap is disposed on the bottom plate and has multiple first pivoting portions. The elastic element is disposed under the keycap. The first bracket is disposed between the keycap and the bottom plate, and the first bracket is pivotally connected to the first pivoting portions. The second bracket is disposed between the keycap and the bottom plate, and the second bracket is rotatably pivoted to the first bracket. The number of the first pivoting portions is greater than two.

In summary, in the key structure of the invention, multiple first pivoting portions are disposed on the keycap and connected to the first bracket, and the number of the first pivoting portions is greater than two, so the keycap may move up and down steadily relative to the bottom plate. Accordingly, the disposition of the original balance bar may be omitted or reduced, so as to eliminate or reduce the noise caused by the balance bar hitting elements, such as the bottom plate and the like when the key structure is pressed. Thereby, the effect of noise reduction is achieved, and the keycap may move up and down steadily relative to the bottom plate as well.

In order to make the features and advantages of the invention comprehensible, embodiments accompanied with drawings are described in detail below.

DESCRIPTION OF THE EMBODIMENTS

Figure 1:
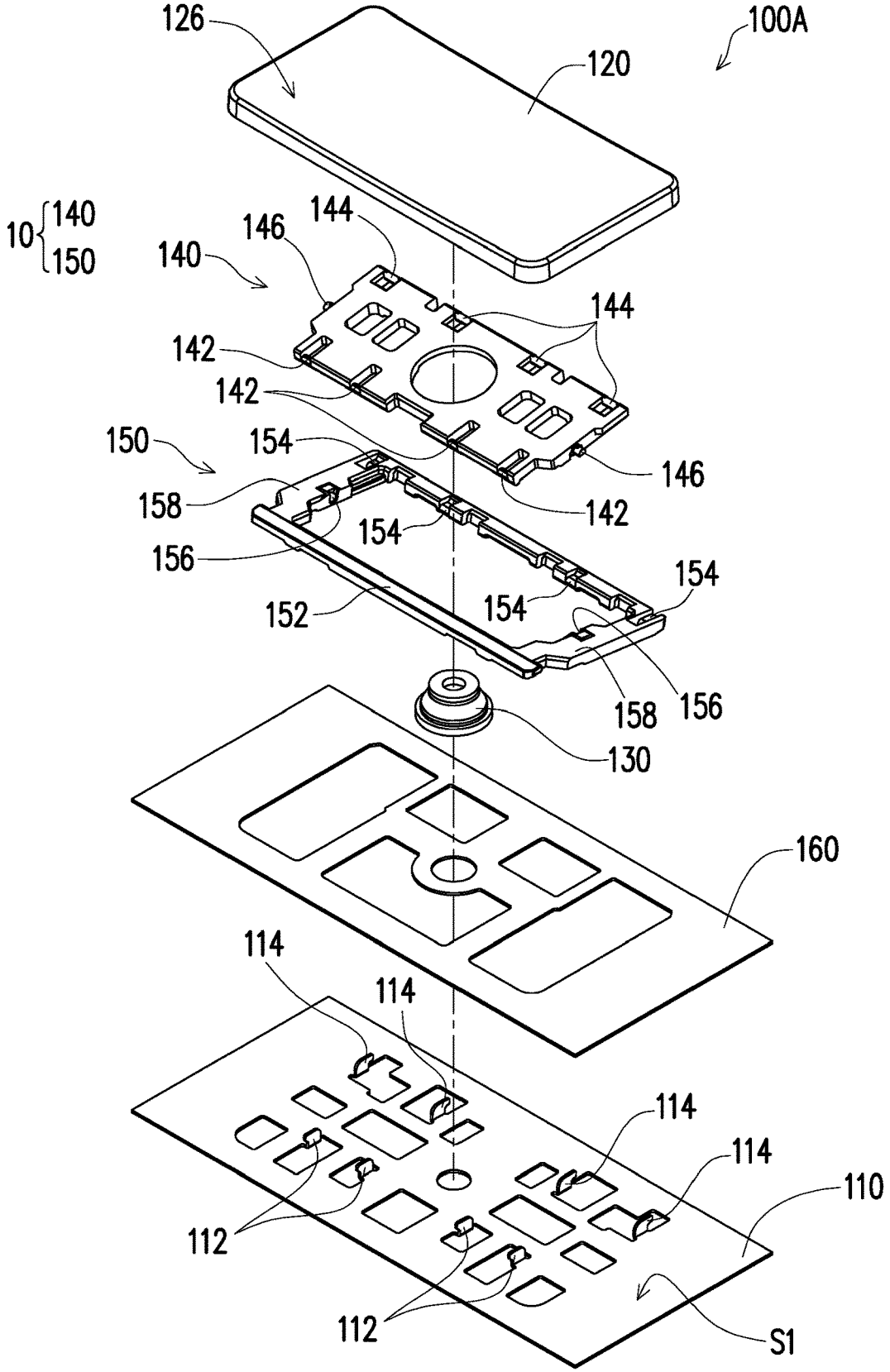
FIG. 1 is an exploded schematic view of a key structure according to an embodiment of the invention.

Reference will now be made in detail to the exemplary embodiments of the invention, examples of which are illustrated in the accompanying drawings. Whenever possible, the same reference numerals are used to represent the same or similar parts in the accompanying drawings and description.

Figure 2:
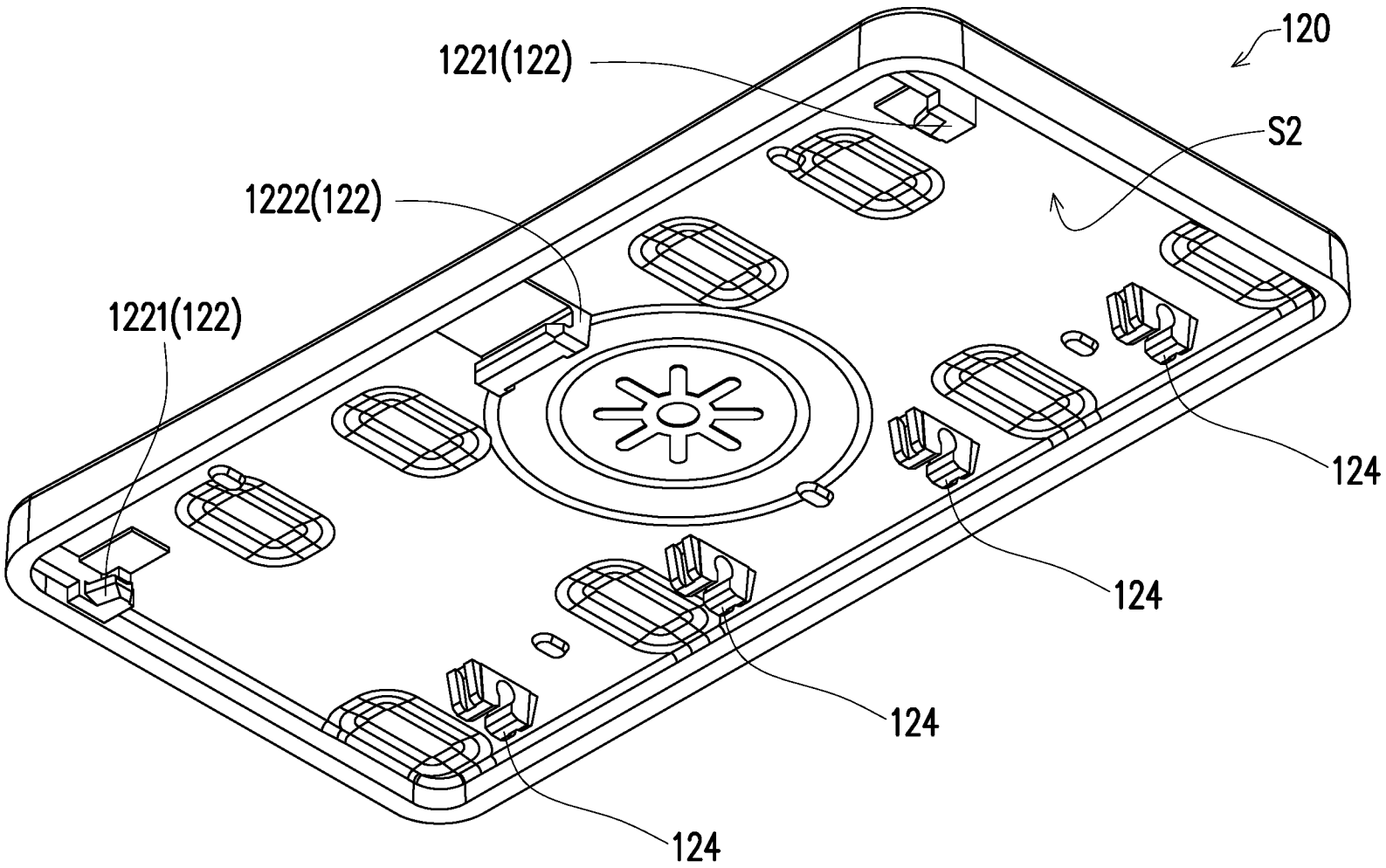
FIG. 2 is a schematic view of an inner surface of the keycap of FIG. 1.
Figure 3:
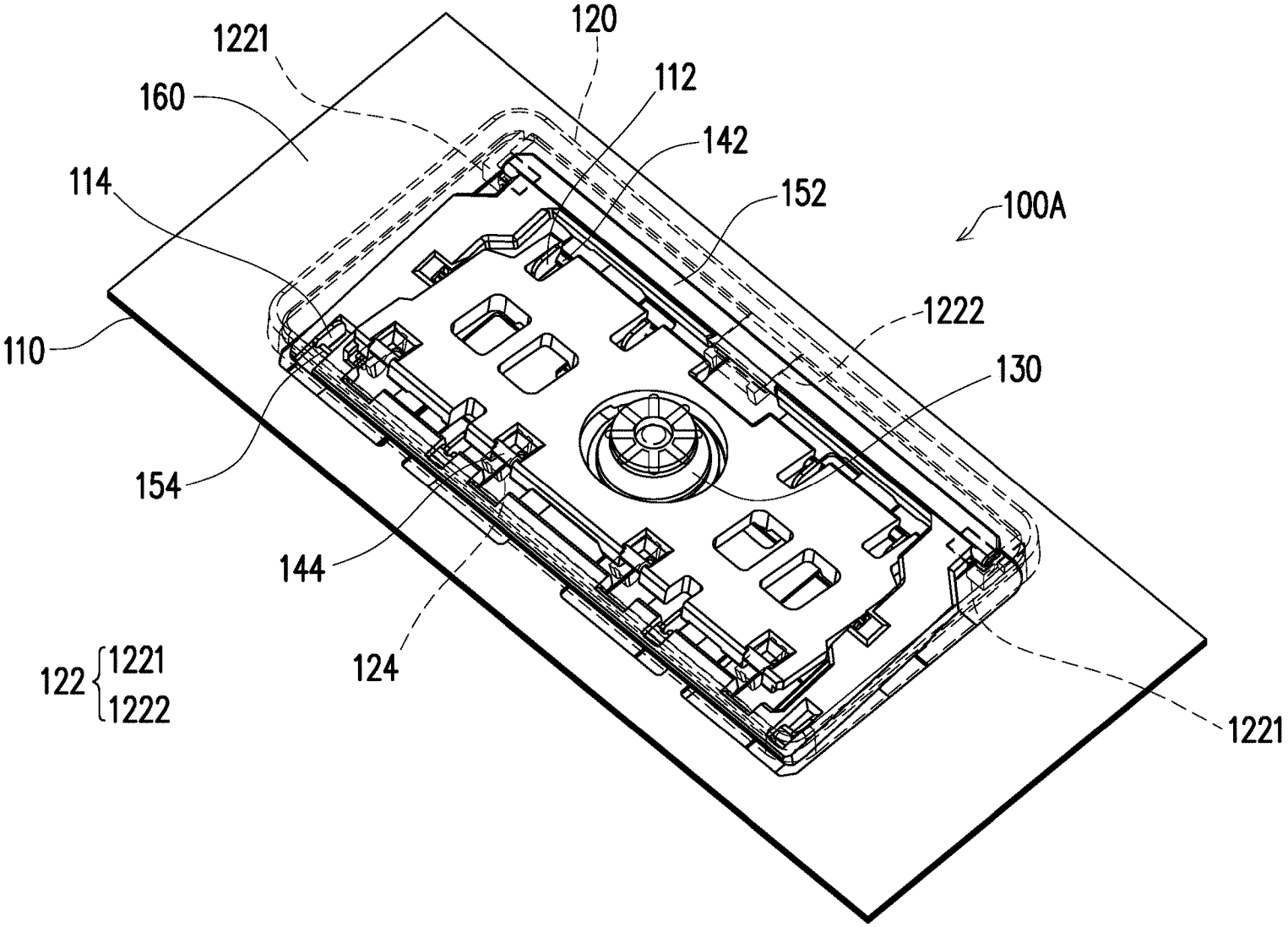
FIG. 3 is a schematic view illustrating an assembly of the key structure of FIG. 1.

FIG. 1 is an exploded schematic view of a key structure according to an embodiment of the invention. FIG. 2 is a schematic view of an inner surface of the keycap of FIG. 1. FIG. 3 is a schematic view illustrating an assembly of the key structure of FIG. 1. Referring to FIG. 1, FIG. 2, and FIG. 3, a key structure 100A of the embodiment includes a bottom plate 110, a keycap 120, an elastic element 130, a thin film circuit board 160, and a support element 10. The keycap 120 is disposed on the bottom plate 110. The elastic element 130 is disposed under the keycap 120. The support element 10 is disposed between the keycap 120 and the bottom plate 110, and the support element 10 includes a first bracket 140 and a second bracket 150. In the embodiment, the first bracket 140 is rotatably pivotally connected to the second bracket 150 to form a scissor-type support element, but the disclosure is not limited thereto.

In the embodiment, the thin film circuit board 160 is disposed on the bottom plate 110 and is located under the elastic element 130. The key structure 100A is movably connected to the bottom plate 110 through the bottom end of the first bracket 140 and the bottom end of the second bracket 150, respectively, and the top end of the first bracket 140 and the top end of the second bracket 150 are respectively movably connected to the keycap 120 so that the keycap 120 moves up and down smoothly relative to the bottom plate 110. For example, when the keycap 120 is pressed, the elastic element 130 is correspondingly squeezed and deformed and then presses down on the thin film circuit board 160 to trigger a switch to generate a pressing signal; and once the force pressing the keycap 120 is removed, the elastic restoring force of the elastic element 130 drives the keycap 120 to return upward to the original position.

In the embodiment, the key structure 100A is a multiple-width key (long key structure), such as a corresponding Enter key in the keyboard. However, in other embodiments, the key structure may also be a large-sized key corresponding to space key, Shift key, and backspace key in the keyboard.

Specifically, in the embodiment, the number of connections between the first bracket 140 and the keycap 120 is greater than two, and the number of connections between the second bracket 150 and the keycap 120 is greater than two. The number of connections between the first bracket 140 and the bottom plate 110 is greater than two, and the number of connections between the second bracket 150 and the bottom plate 110 is greater than two. Accordingly, manufacturers do not need to configure additional balance bars or may appropriately reduce the number of balance bars, so that the keycap 120 may move up and down steadily relative to the bottom plate 110.

In the key structure 100A of the embodiment, the disposition of the balance bar is omitted, so when the user presses the key structure 100A, there may be no noise caused by the balance bar hitting elements, such as the bottom plate 110 or the like, the noise reduction effect is achieved, and the keycap 120 may move up and down steadily relative to the bottom plate 110 as well.

Referring to FIG. 1 and FIG. 2, in the embodiment, the keycap 120 has a key surface 126 and an inner surface S2 opposite to each other. The keycap 120 has multiple first pivoting portions 124 (four first pivoting portions are shown schematically) and multiple second pivoting portions 122 (three second pivoting portions are shown schematically), and the number of the first pivoting portions is greater than two. The number of the second pivoting portions is greater than two. The first pivoting portion 124 and the second pivoting portion 122 respectively extend and protrude from the keycap 120 toward the inner surface S2 of the bottom plate 110.

In the embodiment, the first pivoting portion 124 is pivotally connected to the top end of the first bracket 140, and the second pivoting portion 122 is pivotally connected to the top end of the second bracket 150. Specifically, the top end of the first bracket 140 includes a first top shaft portion 144 (four first top shaft portions are shown schematically) for being connected to the first pivoting portion 124. The second bracket 150 includes two rods 158 on two opposite sides of the second bracket 150 and a second top shaft portion 152 connected between the two rods 158. The second top shaft portion 152 is used for being pivotally connected to the second pivoting portion 122. In the embodiment, the two rods 158 have two recesses 156 facing each other for being pivotally connected to the two protrusions 146 of the first bracket 140.

Referring to FIG. 2, in the embodiment, for example, the shape of the first pivoting portion 124 is U-shaped, and the shape of the second pivoting portion 122 is C-shaped, for example. However, in other embodiments, the shape of the first pivoting portion 124 may also be C-shaped or hook-shaped, and the shape of the second pivoting portion 122 may be U-shaped or hook-shaped. As long as the first pivoting portion 124 and the second pivoting portion 122 may be matched with the top end of the first bracket 140 and the top end of the second bracket 150, the shape design of the first pivoting portion 124 and the second pivoting portion 122 is not limited thereto.

In the embodiment, the second pivoting portion 122 includes two engaging portions 1221 on two opposite sides of the keycap 120 and a middle engaging portion 1222, and the middle engaging portion 1222 is disposed between the two engaging portions 1221. The width of the middle engaging portion 1222 of the embodiment is greater than the width of the engaging portion 1221, and the middle engaging portion 1222 may be more firmly connected to the second top shaft portion 152 of the second bracket 150. In other embodiments, the number or the width of the middle engaging portion 1222 may be appropriately increased or adjusted to well match with the second top shaft portion 152 of the second bracket 150, so that the keycap 120 may move up and down steadily relative to the bottom plate 110.

Referring to FIG. 1 and FIG. 3, in the embodiment, the bottom plate 110 has multiple first hooking portions 112 (four first hooking portions are shown schematically) and multiple second hooking portions 114 (four second hooking portions are shown schematically), and the number of the first hooking portions 112 is greater than two. The number of the second hooking portions 114 is greater than two. The first hooking portion 112 and the second hooking portion 114 respectively extend and protrude from the bottom plate 110 toward an upper surface S1 of the keycap 120.

In the embodiment, the first hooking portion 112 is pivotally connected to the bottom end of the first bracket 140, and the second hooking portion 114 is pivotally connected to the bottom end of the second bracket 150. Specifically, the bottom end of the first bracket 140 includes multiple first bottom shaft portions 142 (four first bottom shaft portions are shown schematically) for being pivotally connected to the first hooking portion 112, and the bottom end of the second bracket 150 includes multiple second bottom shaft portions 154 (four second bottom shaft portions are shown schematically) for being pivotally connected to the second hooking portion 114. Meanwhile, the shapes of the first hooking portion 112 and the second hooking portion 114 are hook-shaped, for example. However, in other embodiments, the shapes of the first hooking portion 112 and the second hooking portion 114 may also be C-shaped or U-shaped. As long as the first hooking portion 112 and the second hooking portion 114 may be matched with the bottom end of the first bracket 140 and the bottom end of the second bracket 150 respectively, the shape design of the first hooking portion 112 and the second hooking portion 114 is not limited thereto.

Other embodiments are listed in the subsequent paragraphs for illustration. Note that the reference numerals and part of the content of the foregoing embodiment are used in the following embodiments, the same reference numerals are used to represent the same or similar elements, and the illustration of the same technical content is omitted. For the omitted illustration, refer to the foregoing embodiment, which is not iterated herein.

Figure 4:
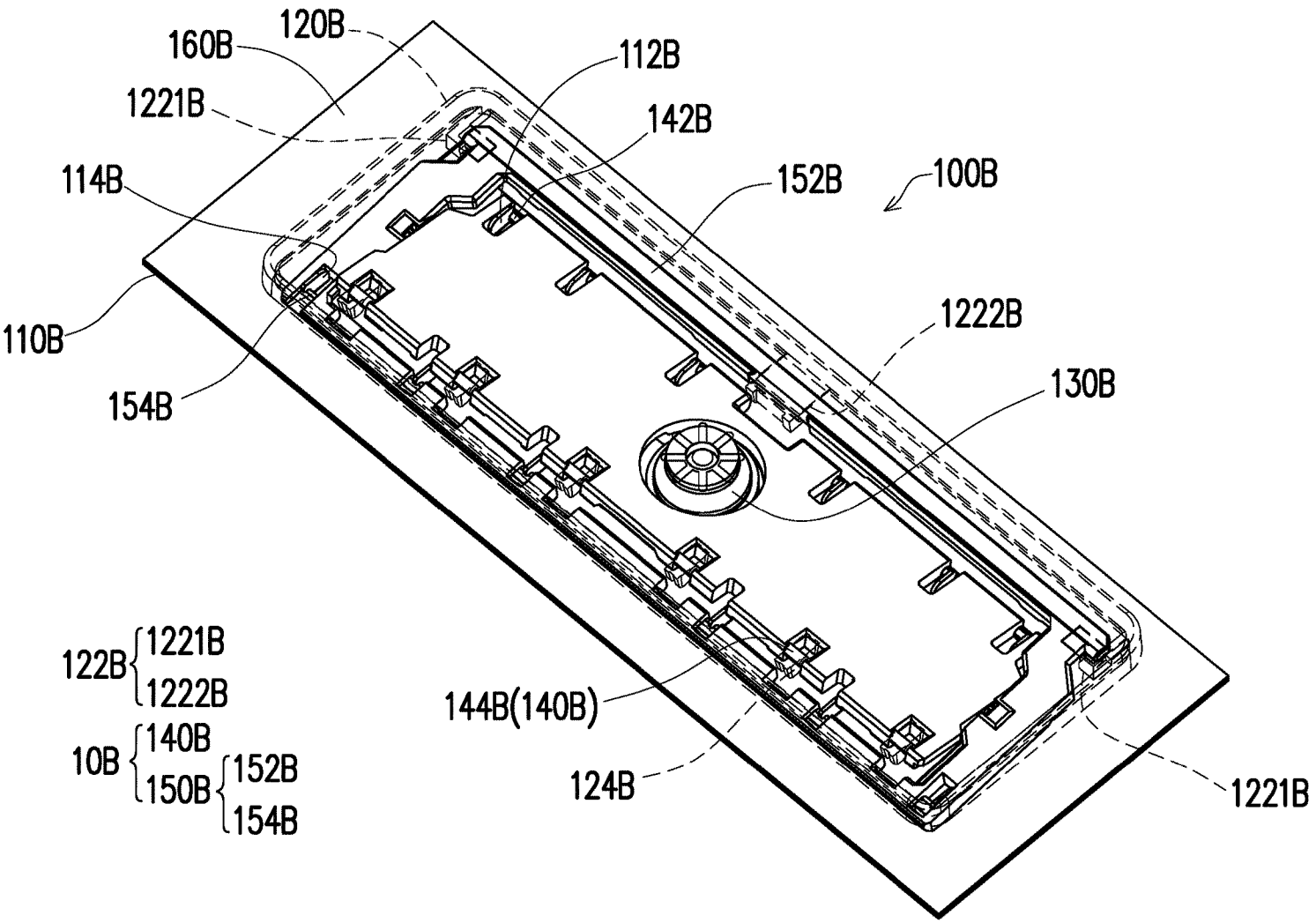
FIG. 4 is a schematic view illustrating an assembly of a key structure according to another embodiment of the invention.

FIG. 4 is a schematic view illustrating an assembly of a key structure according to another embodiment of the invention. In the embodiment, a key structure 100B is slightly different from the key structure 100A of FIG. 3, and the main difference is that the key structure 100B of the embodiment is a multiple-width key (long key structure), such as a corresponding space bar in the keyboard, longer than the key structure 100A. Accordingly, the number of pivoting portions on the keycap and the number of the hooking portions on the bottom plate may be appropriately increased.

For example, a first pivoting portion 124B (six first pivoting portions are shown schematically) on a keycap 120B is connected to a first top shaft portion 144B (six first top shaft portions are shown schematically) of a first bracket 140B, and a second pivoting portion 122B is connected to a second top shaft portion 152B of a second bracket 150B. A first hooking portion 112B (six first hooking portions are shown schematically) on a bottom plate 110B is connected to a first bottom shaft portion 142B (six first bottom shaft portions are shown schematically) of the first bracket 140B, and a second hooking portion 114B (six second hooking portions are shown schematically) is connected to a second bottom shaft portion 154B (six second bottom shaft portions are shown schematically) of the second bracket 150B.

In the embodiment, the number of the pivoting portions on the keycap 120B and the number of the hooking portions on the bottom plate 110B are increased, and the number of connections between the top end and bottom end of a support element 10B and the keycap 120B and the bottom plate 110B, respectively, is increased, so that the keycap 120B moves up and down steadily relative to the bottom plate 110B. Accordingly, manufacturers do not need to configure additional balance bars or may appropriately reduce the number of balance bars, so as to eliminate or reduce the noise caused by the balance bar hitting elements, such as the bottom plate and the like, when the key structure is pressed. Thereby, the effect of noise reduction is achieved, and the keycap 120B may move up and down steadily relative to the bottom plate 110B as well.

Figure 5A:
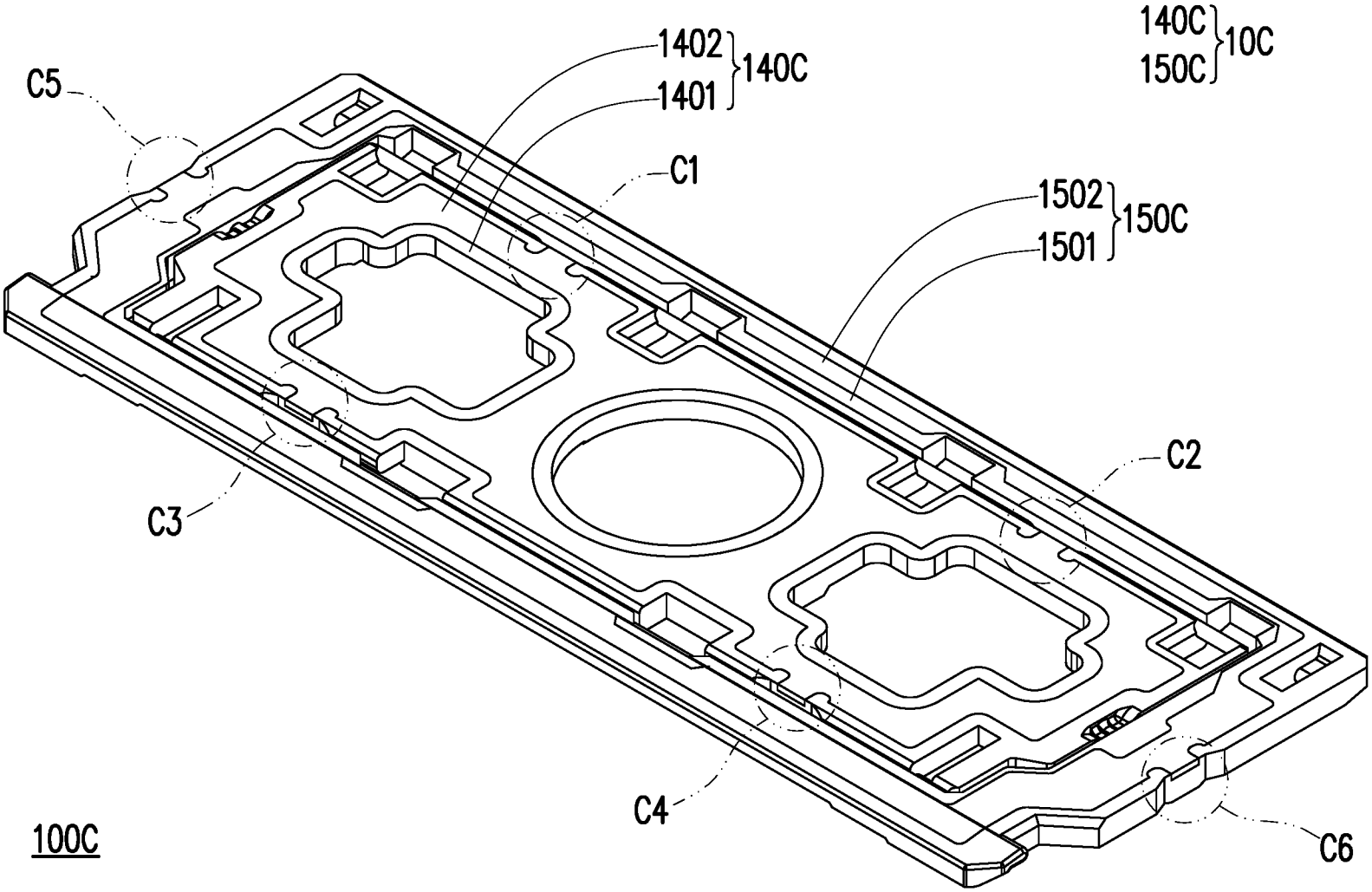
FIG. 5A is a three-dimensional schematic view of a first bracket and a second bracket according to another embodiment of the invention.
Figure 5B:
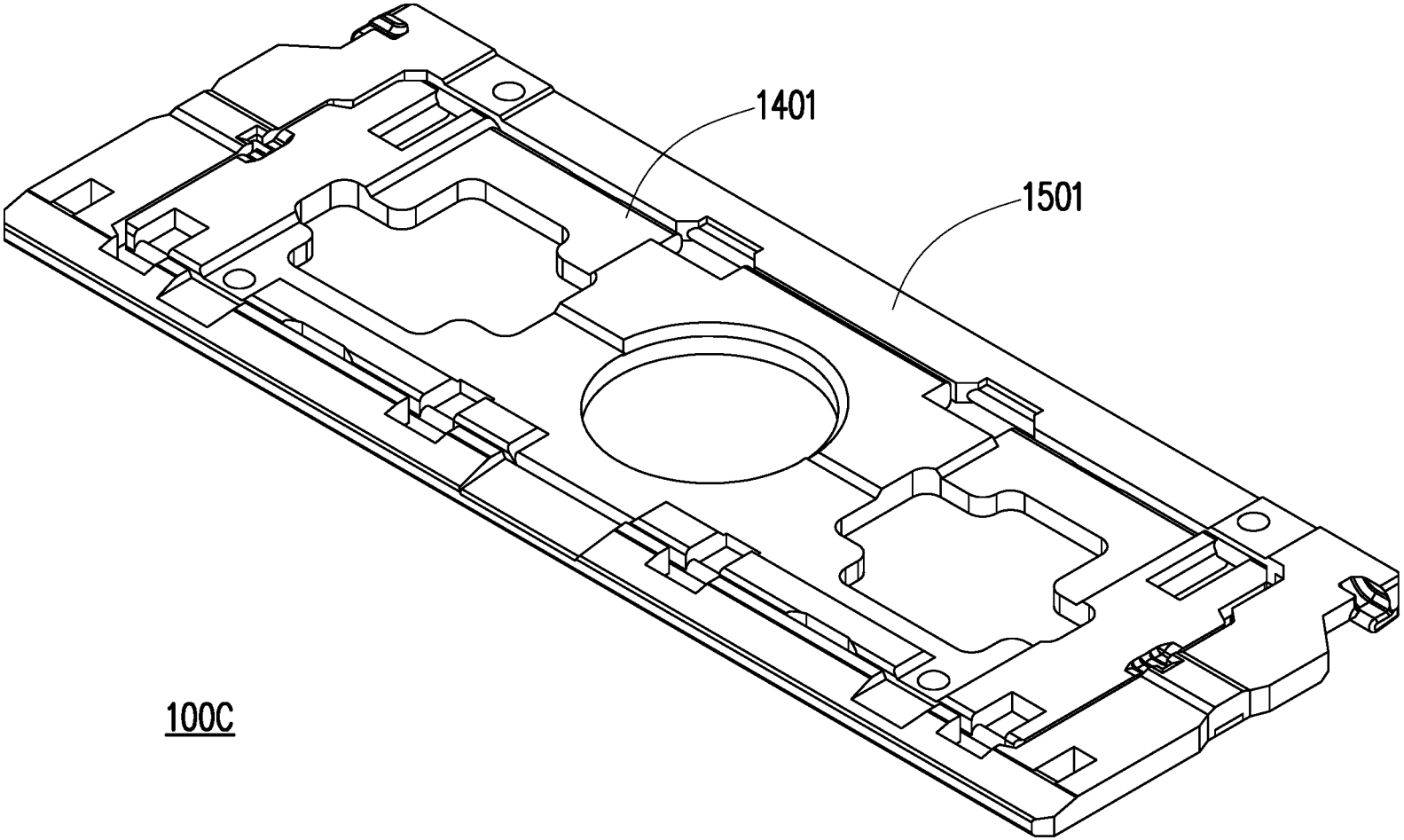
FIG. 5B is a three-dimensional schematic view of the first bracket and the second bracket of FIG. 5A from another perspective.
Figure 5C:
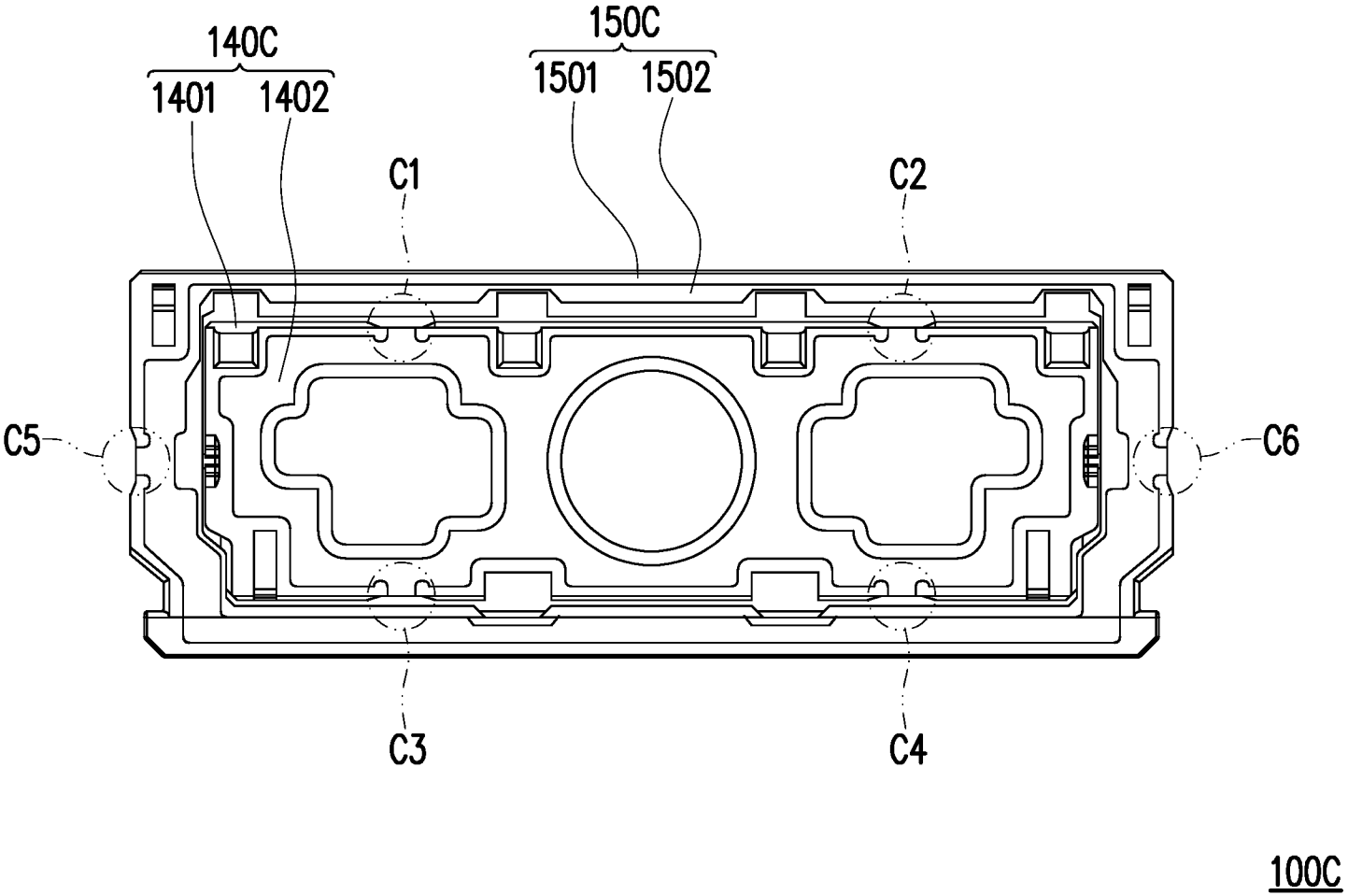
FIG. 5C is a schematic top view of the first bracket and the second bracket of FIG. 5A.

FIG. 5A is a three-dimensional schematic view of a first bracket and a second bracket according to another embodiment of the invention. FIG. 5B is a three-dimensional schematic view of the first bracket and the second bracket of FIG. 5A from another perspective. FIG. 5C is a schematic top view of the first bracket and the second bracket of FIG. 5A. Referring to FIG. 5A first, in the embodiment, a key structure 100C is slightly different from the key structure 100A of FIG. 3, and the main difference is that a first bracket 140C and a second bracket 150C in the embodiment are formed by a metal insert molding process, which may strengthen the overall strength of the support element 10C (scissor-type support element). Since other portions of the key structure, such as the structure of the keycap and the bottom plate, and the connection modes of the first and second brackets with the keycap and the bottom plate are substantially the same, the other portions are not illustrated in detail in the embodiment, and the relevant structures are not shown in the drawings. In the subsequent paragraphs, only the difference is illustrated in detail.

In the embodiment, the first bracket 140C includes a first portion 1401 and a second portion 1402, and the material of the first portion 1401 is different from the material of the second portion 1402. The second bracket 150C includes a third portion 1501 and a fourth portion 1502, and the material of the third portion 1501 is different from the material of the fourth portion 1502. For example, the material of the first portion 1401 and the third portion 1501 is plastic, and the material of the second portion 1402 and the fourth portion 1502 is metal. When the key structure 100C of FIG. 5A is flipped over and seen from the back, as shown in FIG. 5B, the back (a first surface S3 in FIG. 5D) of the second portion 1402 is completely covered by the first portion 1401, and the back (a second surface S4 in FIG. 5E) of the fourth portion 1502 is completely covered by the third portion 1501. Note that, in the embodiment, only part of the surface of the second portion 1402 is covered by the first portion 1401, and only part of the surface of the fourth portion 1502 is covered by the third portion 1501. However, in other embodiments, the entire surface of the second portion 1402 may be covered by the first portion 1401, and the entire surface of the fourth portion 1502 is covered by the third portion 1501, which is not limited in this application.

Referring to FIG. 5A and FIG. 5C, in the embodiment, the two opposite sides of the second portion 1402 include multiple first connecting portions C1, C2, C3, and C4; the first portion 1401 covers the second portion 1402 and exposes the first connecting portions C1, C2, C3, and C4. That is, the side of the second portion 1402 is not completely enclosed by the first portion 1401. Therefore, the first connecting portions C1, C2, C3, and C4 are respectively used to be connected to an external structure (not shown).

In the embodiment, the two opposite sides of the fourth portion 1502 include multiple second connecting portions C5 and C6, and the third portion 1501 covers the fourth portion 1502 and exposes the second connecting portions C5 and C6. In other words, the side of the fourth portion 1502 is not completely enclosed by the third portion 1501. Therefore, the second connecting portions C5 and C6 are respectively used to be connected to an external structure (not shown). Meanwhile, the external structure is a support part and a clamping part, for example. For example, the support part and the clamping part are structures used for positioning and fixing the structure of the inner scissor metal element and the structure of the outer scissor metal element (i.e., the second portion 1402 and the fourth portion 1502) in the mold.

Generally speaking, in the injection molding process, when metal elements are in contact with the mold, burrs may be generated. In the embodiment, the structure of the inner scissor metal element and the structure of the outer scissor metal element (i.e., the second portion 1402 and the fourth portion 1502) are connected to the external support part or clamping part through multiple first connecting portions and multiple second connecting portions. After the injection molding is completed, the first bracket 140C and the second bracket 150C may be taken out from the support part or the clamping part. Accordingly, the second portion 1402 of the first bracket 140C and the fourth portion 1502 of the second bracket 150C may be prevented from being in contact with the mold, so as to prevent burrs. Since the contact between the metal element and the plastic mold is prevented, the stability of the mold and the product may be improved, and the life of the mold may be improved.

Figure 5D:
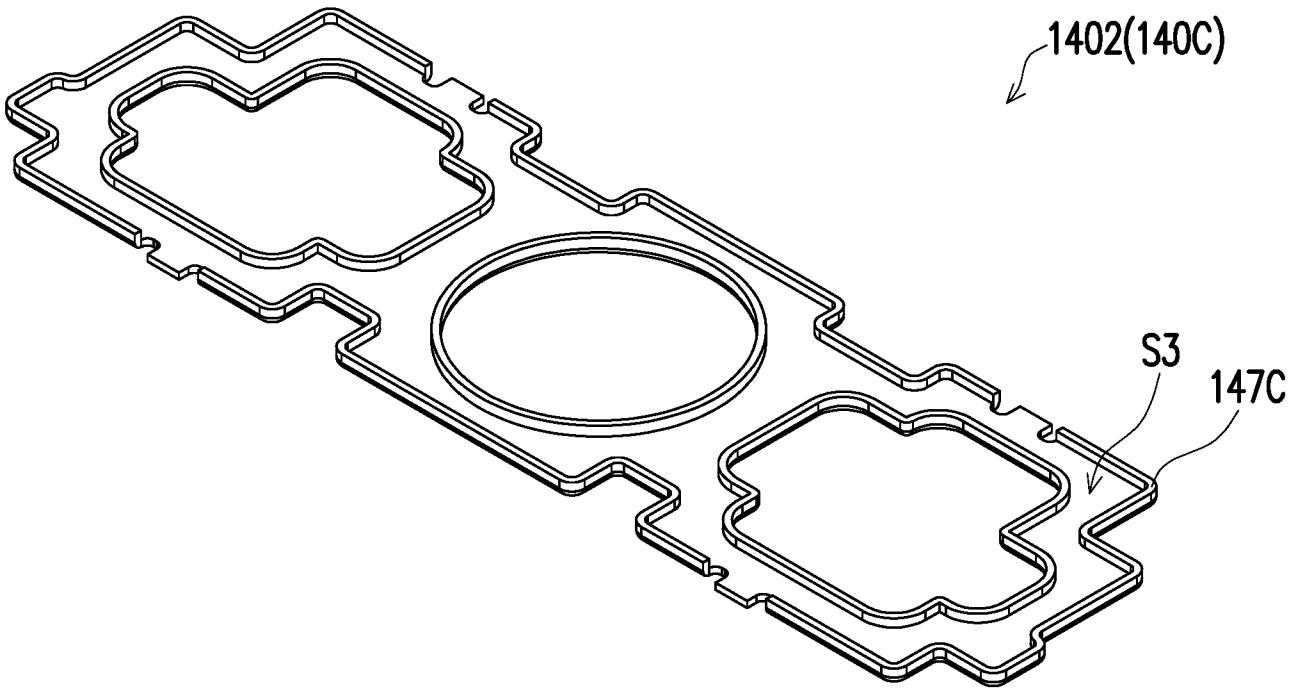
FIG. 5D is a three-dimensional schematic view of a second portion of the first bracket of FIG. 5A.
Figure 5E:
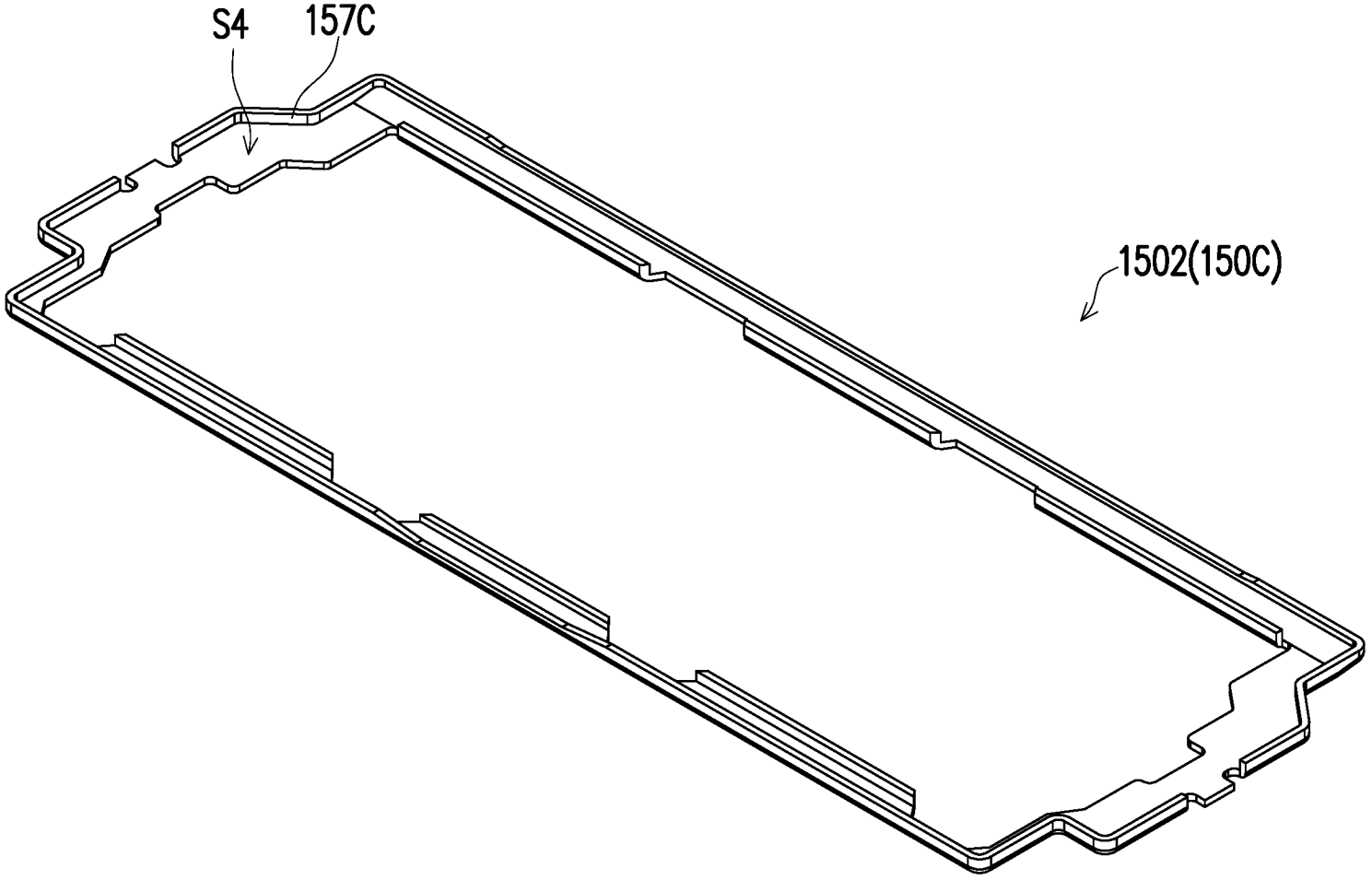
FIG. 5E is a three-dimensional schematic view of a fourth portion of the second bracket of FIG. 5A.

FIG. 5D is a three-dimensional schematic view of a second portion of the first bracket of FIG. 5A. Referring to FIG. 5D, the second portion 1402 has the first surface S3 and includes a first flange portion 147C. The first flange portion 147C is disposed at an edge of the second portion 1402 and bent toward the first surface S3. FIG. 5E is a three-dimensional schematic view of a fourth portion of the second bracket of FIG. 5A. Referring to FIG. 5E, the fourth portion 1502 has the second surface S4 and includes a second flange portion 157C. The second flange portion 157C is disposed at an edge of the fourth portion 1502 and bent toward the second surface S4. With the flange structure, the bonding force between the metal element and the plastic may be increased, so the strength of the scissor-type support element may be enhanced.

Figure 6:
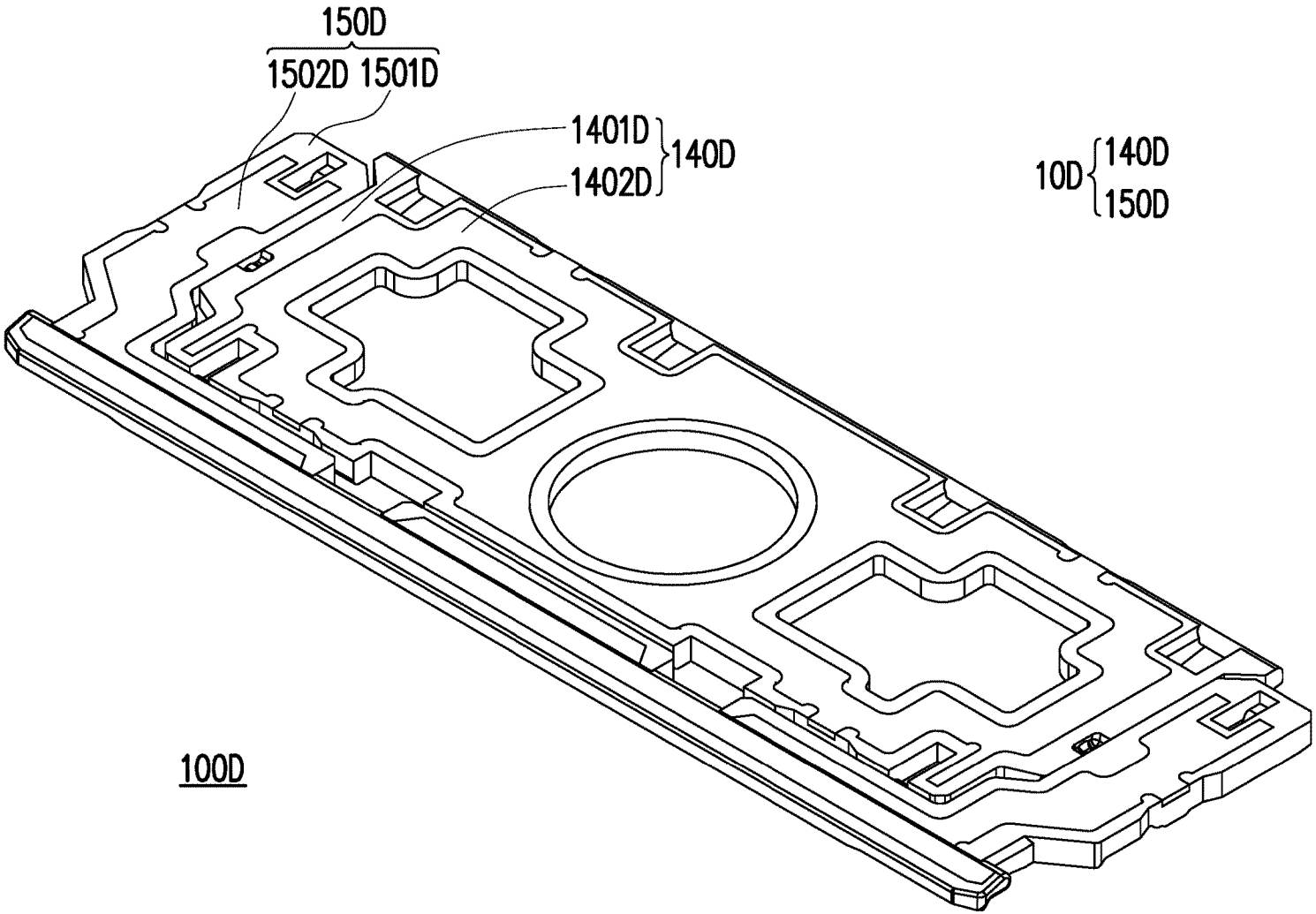
FIG. 6 is a three-dimensional schematic view of a first bracket and a second bracket according to another embodiment of the invention.
Figure 7:
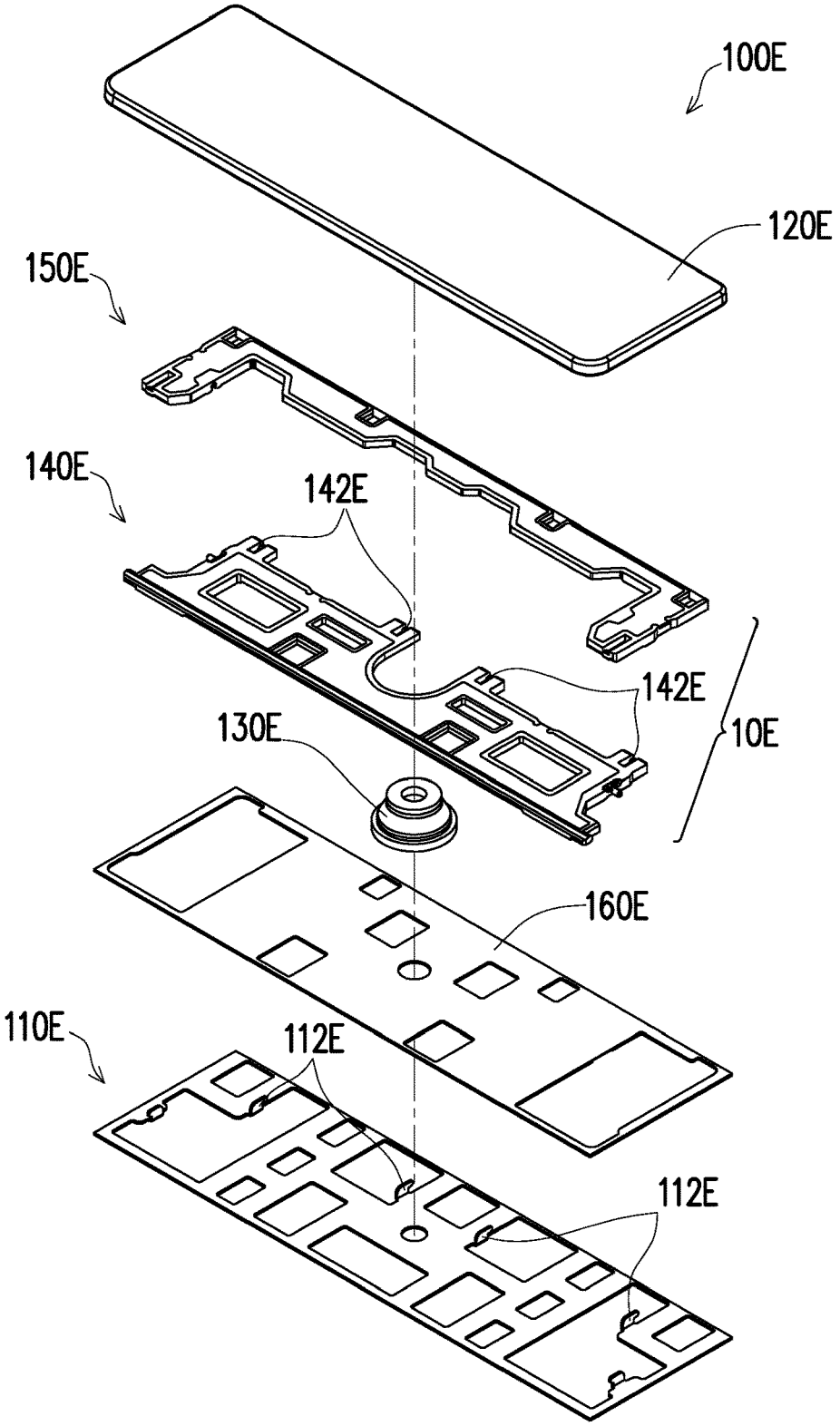
FIG. 7 and FIG. 8A are exploded schematic views of a key structure according to other embodiments of the invention.
Figure 8A:
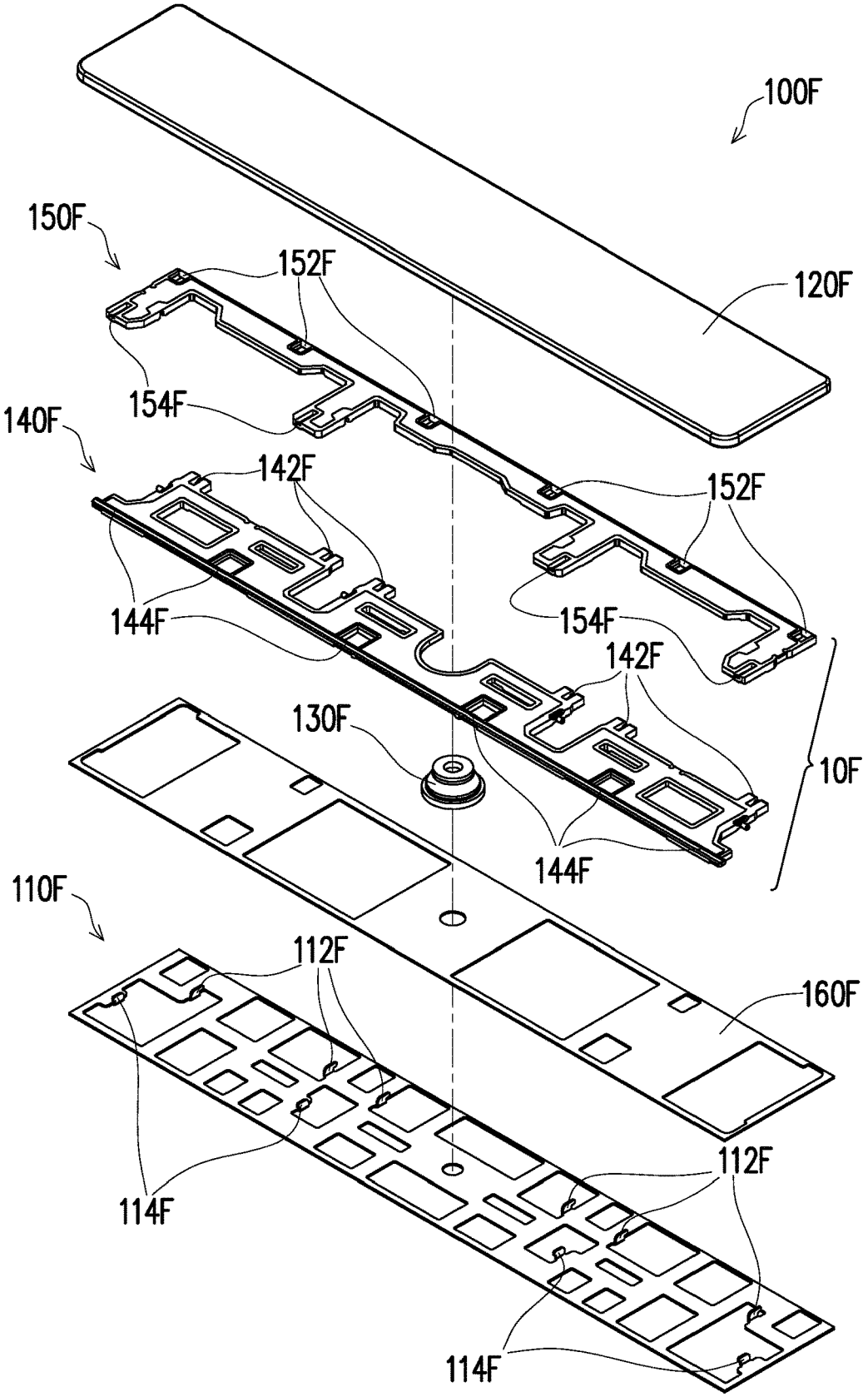
Figure 8B:
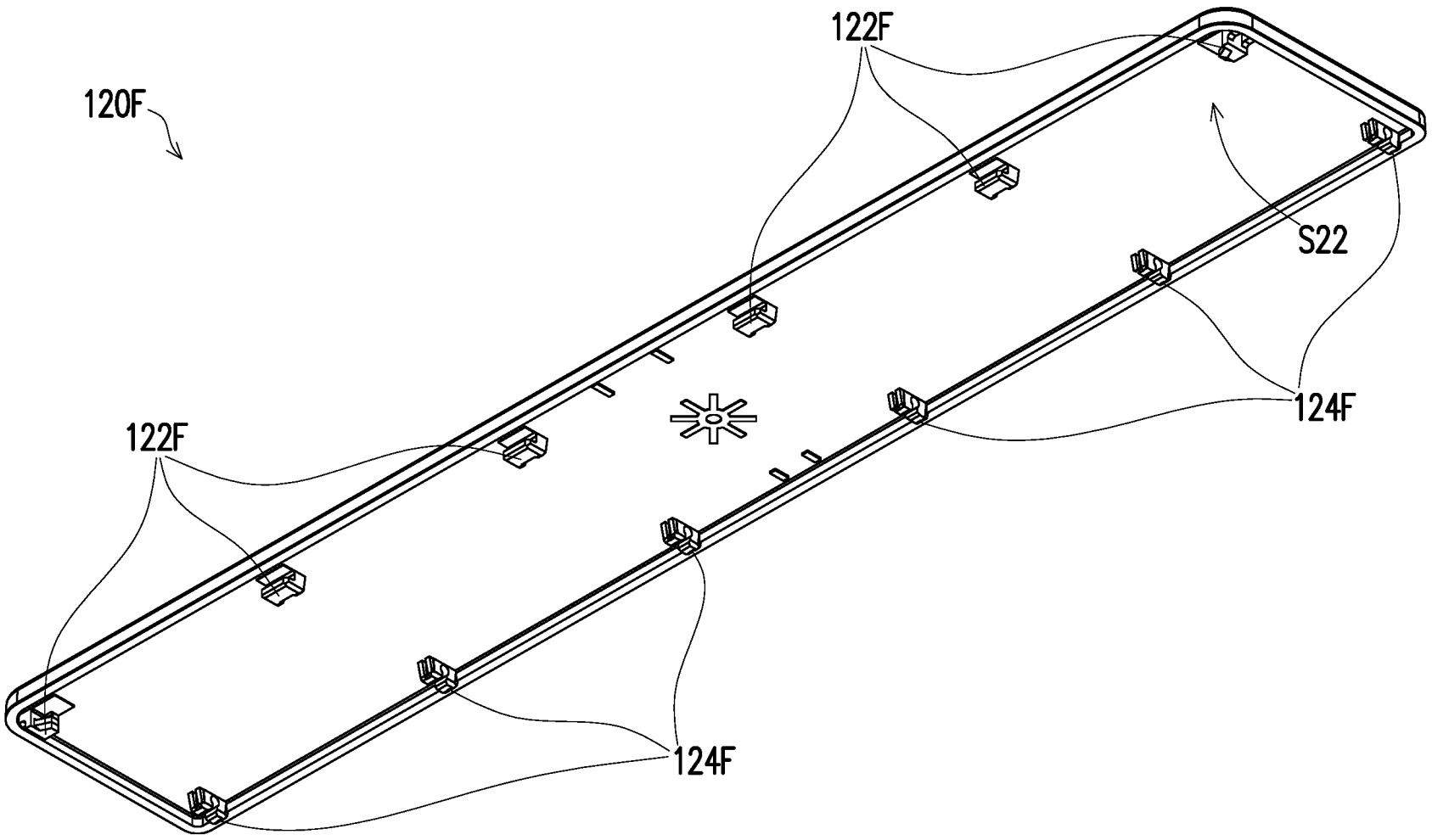
FIG. 8B is a schematic view of an inner surface of a keycap of FIG. 8A.

FIG. 6 is a three-dimensional schematic view of a first bracket and a second bracket according to another embodiment of the invention. FIG. 7 and FIG. 8A are exploded schematic views of a key structure according to other embodiments of the invention. FIG. 8B is a schematic view of an inner surface of a keycap of FIG. 8A. Referring to FIG. 6 first, in the embodiment, a key structure 100D is slightly different from the key structure 100C of FIG. 5A, and the main difference is the type of a support element 10D. Specifically, the second bracket 150C of FIG. 5A is disposed around the four sides of the first bracket 140C. A second bracket 150D of the embodiment is not disposed completely around a first bracket 140D but around three sides of the first bracket 140D. That is, the shape of the second bracket 150C of FIG. 5A is roughly mouth-shaped, the first bracket 140C is disposed in the mouth-shaped opening of the second bracket 150C, and the first bracket 140C is completely surrounded by the second bracket 150C. The shape of the second bracket 150D of the embodiment is U-shaped. The first bracket 140D is disposed in the U-shaped opening of the second bracket 150D. The first bracket 140D is not completely surrounded by the second bracket 150D. Accordingly, the material may be reduced, and the cost may be decreased.

Moreover, the external structures of the first bracket 140D and the second bracket 150D shown in FIG. 6 may also be applied to other embodiments. For example, the second brackets 150 and 150B in the key structure of FIG. 1 and FIG. 4 may not be disposed completely around the first brackets 140 and 140B, which is not limited in this application. As shown in FIG. 7, in the embodiment, a key structure 100E is slightly different from the key structure 100D of FIG. 6, and the main difference is that the number of connections between the top end and the bottom end of a support element 10E and a keycap 120E and a bottom plate 110E, respectively, is increased.

For example, the number of first hooking portions 112E of the bottom plate 110E is four, and the number of bottom shaft portions 142E of a first bracket 140E of the support element 10E is four. The first hooking portion 112E is pivotally connected to the bottom shaft portion 142E. For other portions of the key structure 100E, such as the keycap 120E, an elastic element 130E, a thin film circuit board 160E, and the like, refer to the foregoing description, which is not illustrated in detail in the embodiment.

As shown in FIG. 8A and FIG. 8B, in the embodiment, a key structure 100F is slightly different from the key structure 100E of FIG. 7, and the main difference is that the key structure 100F of the embodiment is a multiple-width key (long key structure) longer than the key structure 100E. Accordingly, the number of connections between the top end and bottom end of a support element 10F and a keycap 120F and a bottom plate 110F, respectively, is increased.

For example, in the embodiment, the number of first hooking portions 112F of the bottom plate 110F is six, the number of second hooking portions 114F is four, and the number of bottom shaft portions 142F of a first bracket 140F of the support element 10F is six. The bottom shaft portion 142F is pivotally connected to the first hooking portion 112F. The number of bottom shaft portions 154F of a second bracket 150F of the support element 10F is four, and the bottom shaft portion 154F is pivotally connected to the second hooking portions 114F. The number of first pivoting portions 124F on an inner surface S22 of the keycap 120F is six, the number of second pivoting portions 122F is six, and the number of top shaft portions 144F of the first bracket 140F of the support element 10F is six. The top shaft portion 144F is pivotally connected to the first pivoting portion 124F. The number of top shaft portions 152F of the second bracket 150F of the support element 10F is six, and the top shaft portion 152F is pivotally connected to the second pivoting portion 122F. For other portions of the key structure 100F, such as an elastic element 130F, a thin film circuit board 160F, and the like, refer to the foregoing description, which is not illustrated in detail in the embodiment.

In summary, the key structure of the invention is a multiple-width key, for example. The key structure includes the first bracket and the second bracket. The keycap moves up and down relative to the bottom plate through the first bracket and the second bracket. Multiple first pivoting portions are disposed on the keycap and connected to the first bracket, and the number of the first pivoting portions is greater than two, so the keycap may move up and down steadily relative to the bottom plate. Accordingly, the disposition of the original balance bar may be omitted or reduced, so as to eliminate or reduce the noise caused by the balance bar hitting elements, such as the bottom plate and the like when the key structure is pressed. Thereby, the effect of noise reduction is achieved, and the keycap may move up and down steadily relative to the bottom plate as well. On the other hand, the first bracket and the second bracket of the invention may be formed by a metal insert molding process to enhance the overall strength of the scissor-type support element.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A key structure, comprising:

a bottom plate;

a keycap disposed on the bottom plate with a plurality of first pivoting portions;

an elastic element disposed under the keycap;

a first bracket disposed between the keycap and the bottom plate, wherein the first bracket is pivotally connected to the first pivoting portions; and a second bracket disposed between the keycap and the bottom plate, wherein the second bracket is rotatably pivoted to the first bracket, wherein a number of the first pivoting portions is greater than two, the keycap comprises a plurality of second pivoting portions, and the second bracket is pivotally connected to the second pivoting portions, wherein a number of the second pivoting portions is greater than two, the bottom plate comprises a plurality of second hooking portions, and the second bracket is pivotally connected to the second hooking portions, wherein a number of the second hooking portions is greater than two.

2. The key structure according to claim 1, wherein a top end of the second bracket comprises a second top shaft portion pivotally connected to the second pivoting portions, and a bottom end of the second bracket comprises a plurality of second bottom shaft portions pivotally connected to the second hooking portions.

3. The key structure according to claim 1, wherein the second bracket is disposed outside the first bracket, and the second bracket is not disposed completely around the first bracket.

4. The key structure according to claim 1, wherein the bottom plate comprises a plurality of first hooking portions, and the first bracket is pivotally connected to the first hooking portions, wherein a number of the first hooking portions is greater than two.

5. The key structure according to claim 4, wherein a top end of the first bracket comprises a plurality of first top shaft portions pivotally connected to the first pivoting portions, and a bottom end of the first bracket comprises a plurality of first bottom shaft portions pivotally connected to the first hooking portions.

6. The key structure according to claim 1, wherein the first bracket comprises a first portion and a second portion, and a material of the first portion is different from a material of the second portion.

7. The key structure according to claim 6, wherein a side surface of the second portion comprises a plurality of first connecting portions, and the first portion covers the second portion and exposes the first connecting portions.

8. The key structure according to claim 7, wherein the second portion comprises a first surface and a first flange portion, and the first flange portion is disposed at an edge of the second portion and bent toward the first surface.

9. The key structure according to claim 1, wherein the second bracket comprises a third portion and a fourth portion, and a material of the third portion is different from a material of the fourth portion.

10. The key structure according to claim 9, wherein a side surface of the fourth portion comprises a plurality of second connecting portions, and the third portion covers the fourth portion and exposes the second connecting portions.

11. The key structure according to claim 10, wherein the fourth portion comprises a second surface and a second flange portion, and the second flange portion is disposed at an edge of the fourth portion and bent toward the second surface.

* * * * *